US010818204B2

(12) United States Patent
O'Connor

(10) Patent No.: US 10,818,204 B2
(45) Date of Patent: Oct. 27, 2020

(54) PIVOTABLE SIGNPOST SUPPORT DEVICE

(71) Applicant: John O'Connor, Hartford, KS (US)

(72) Inventor: John O'Connor, Hartford, KS (US)

( * ) Notice: Subject to any disclaimer, the term of this patent is extended or adjusted under 35 U.S.C. 154(b) by 0 days.

(21) Appl. No.: 14/482,757

(22) Filed: Sep. 10, 2014

(65) Prior Publication Data

US 2015/0068083 A1 Mar. 12, 2015

Related U.S. Application Data

(60) Provisional application No. 61/875,995, filed on Sep. 10, 2013.

(51) Int. Cl.

| | |
|---|---|
| ***G09F 15/00*** | (2006.01) |
| ***E04H 12/22*** | (2006.01) |
| ***E01F 9/642*** | (2016.01) |
| *E04H 12/18* | (2006.01) |

(52) U.S. Cl.

CPC ..... *G09F 15/0087* (2013.01); *E01F 9/642* (2016.02); *E04H 12/2276* (2013.01); *G09F 15/0075* (2013.01); *E04H 12/187* (2013.01)

(58) Field of Classification Search

CPC ..... G09F 7/18; G09F 17/00; G09F 15/0062; G09F 15/0056; E01F 9/012; E01F 9/019

USPC ..... 40/607.01, 607.04, 607.1

See application file for complete search history.

(56) References Cited

U.S. PATENT DOCUMENTS 3,521,917 A * 7/1970 King ..... E01F 9/0182 248/158
3,591,116 A * 7/1971 Dalum ..... E01F 9/012 211/195
4,236,843 A * 12/1980 Chisholm ..... E01F 9/0182 285/4
4,278,228 A * 7/1981 Rebentisch ..... E01F 9/0182 248/548
4,490,062 A * 12/1984 Chisholm ..... E01F 9/0182 29/897
4,848,954 A * 7/1989 Wiseman ..... F16B 7/18 29/401.1
5,125,194 A * 6/1992 Granger ..... E01F 9/0117 403/2
5,160,111 A 11/1992 Hugron
5,484,217 A * 1/1996 Carroll ..... E01F 9/0182 248/548
5,703,577 A 12/1997 Carter
6,149,340 A 11/2000 Pateman
6,398,192 B1 * 6/2002 Albritton ..... E01F 9/0182 256/1

(Continued)

*Primary Examiner* — Shin Kim

(74) *Attorney, Agent, or Firm* — Daniel Boudwin; Boudwin Intellectual Property Law, LLC

(57) ABSTRACT

Disclosed is a pivotable signpost support device. The device includes a signpost support that is vertically aligned with a ground post support, wherein the signpost support is disposed above the ground post support that is affixed to a ground post. The signpost support and the ground post support are secured between first vertical support and a second vertical support. The signpost support is pivotally secured to the first and second vertical supports by means of a pivot bolt having a die spring at an end thereof, so that it can pivot forward and backward relative to the first and second vertical supports. The pivot bolt can tighten the die spring so as to keep the signpost support in an upright position but allowing the signpost support to fall into a collapsed position.

8 Claims, 4 Drawing Sheets

(56) References Cited

U.S. PATENT DOCUMENTS

| | | | | |
|---|---|---|---|---|
| 6,488,268 | B1 * | 12/2002 | Albritton | E01F 9/0182 256/13.1 |
| 6,619,630 | B2 * | 9/2003 | Albritton | E01F 9/0182 256/1 |
| 6,793,204 | B2 * | 9/2004 | Albritton | E01F 9/0182 256/13.1 |
| 6,886,813 | B2 * | 5/2005 | Albritton | E01F 9/0182 256/13.1 |
| 7,685,754 | B1 | 3/2010 | Torres | |
| 7,726,056 | B2 * | 6/2010 | Brodie | E04H 12/2215 248/160 |
| 8,038,126 | B1 * | 10/2011 | Albritton | E01F 9/0182 256/13.1 |
| 8,176,665 | B2 * | 5/2012 | Petrovic | A47B 91/00 40/606.01 |
| 8,978,225 | B2 * | 3/2015 | James | E01F 9/0182 29/413 |
| 2008/0029660 | A1 * | 2/2008 | Kokenes | E01F 9/0124 248/158 |
| 2008/0209784 | A1 * | 9/2008 | Brodie | E04H 12/2215 40/607.04 |

* cited by examiner

PIVOTABLE SIGNPOST SUPPORT DEVICE

CROSS REFERENCE TO RELATED APPLICATION

This application claims the benefit of U.S. Provisional Application No. 61/875,995 filed on Sep. 10, 2013. The above identified patent application is herein incorporated by reference in its entirety to provide continuity of disclosure.

BACKGROUND OF THE INVENTION

1. Field of the Invention

The present invention relates to a signpost support device. More specifically, the present invention pertains to an improved signpost support device that can be pivoted forward and backward upon impact without causing damage to a signpost that is mounted to the device. The present invention is suitable for use with new and existing signposts and street signs on narrow roadways and bridges.

In rural areas, many roadways, culverts, and bridges are narrow and allow only one vehicle to pass at a time. These roadways typically comprise posted street signs that prevent vehicles from going off of the road and into the deep ditches. Many wide farming equipment and vehicles, however, can knock over these signs as they drive by, damaging the signs and causing the signs to fall into the surrounding banks where the signs are no longer visible to drivers. Damaged signs are time consuming and costly to repair, and can cause traffic hazard.

Additionally, conventional street signs can cause damage to the farming equipment and vehicles when they are hit. The street signs can get caught onto various vehicle parts or scrape the exterior parts of a vehicle. This can further complicate vehicle commute in rural areas and inconvenience drivers and road constructions alike.

The present invention provides a signpost support device that can be used in narrow roadways and bridges. The device comprises a signpost support and a ground post support disposed between a first and second vertical posts. The ground post support can attach to a ground post to secure the device in an upright position. The signpost support can attach to a conventional street signpost. The signpost support is connected to the first and second vertical posts via a pivot bolt having a die spring at an end thereof. When pressure is applied to the signpost, the die spring compresses, allowing the signpost support to pivot from an upright position towards the ground. In this way, the street signpost can fold down when hit by a wide farming equipment or other vehicles, thereby decreasing damages to the street signs, as well as to the farming equipment and passing vehicles. The street signpost can thereafter be retrieved and positioned back to its original, upright position.

2. Description of the Prior Art

Devices have been disclosed in the prior art that claim street sign supports. These include devices that have been patented and published in patent application publications. Some devices in the prior art disclose a post that is placed in the ground with a spring mechanism that permits the sign to pivot toward the ground. These devices, however, do not disclose a signpost support with a pivot bolt and a die spring that attaches to an existing street sign. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,149,340 to Pateman and U.S. Pat. No. 4,729,690 to Lavender disclose self-righting street signs or street markers comprising a plate for connecting to the signpost and a tray secured to the ground. The plate is connected to a chain that extends through a hole in the tray, and connects to a compression spring. When the signpost is knocked over, the chain automatically pulls the plate and the signpost back into an upright position.

The foregoing Pateman and Lavendar devices are directed toward a self-righting street sign that comprises a plate and a tray that are connected by means of a spring mechanism. In contrast, the present invention does not self-right automatically. Instead, the signpost support can be manually moved into an upright position after a passing vehicle or farming equipment has passed. In this way, the present invention does not get caught or further interfere with the passing vehicle or equipment when it falls into a collapsed position. Thus, the present invention is advantageous in that the signpost remains in an upright or a collapsed position as desired or needed.

U.S. Pat. No. 5,160,111 to Hugron discloses a collapsible signaling post comprising a first tubular member mounted to a sign post and a second tubular member secured to the ground. The first tubular member and the second tubular member are removably connected together. Each of the first tubular member and the second tubular member comprises a hollow interior with a chain disposed therein. When force is applied to the first tubular member, it disconnects from the second tubular member so that the first tubular member and the second tubular member are only connected by means of the chain. The device of Hugron, however, is limited in that it comprises two tubular members that are removably connected together. In contrast, the present invention comprises a signpost support that is pivotally connected to a pair of vertical supports such that the signpost support can move from an upright position to a collapsed position. In this way, the signpost support and the vertical supports remain in contact as the signpost is collapsed.

U.S. Pat. No. 7,726,056 to Brodie comprises a knock down signpost comprising a post member and a lower body member held together by a spring and two steel cables. The post member comprises two round protrusions that are aligned with two matching clearance holes in the lower body. As the top assembly is knocked down, it rotates about the clearance holes, which act as a pseudo-hinge. The device of Brodie, however, does not disclose a pair of vertical supports having a signpost support and a ground post support therebetween. The present invention comprises a signpost support and a ground post support, wherein the signpost support is pivotally attached to the pair of vertical supports by means of a pivot bolt. The signpost support and the ground post support are physically independent of one another. In this way, the signpost support can pivot about the vertical supports.

U.S. Pat. No. 7,685,754 to Torres discloses a wind resistant sign comprising a first sign support that is pivotally attached to a second sign support. In one embodiment, the first sign support can pivot horizontally with respect to the second sign support. In another embodiment, the sign support can pivot vertically with respect to the second sign support. The wind resistant sign comprises a spring mechanism so that the sign can automatically spring back into its starting position when the wind speed decreases below the threshold. In contrast, the present invention does not disclose a sign that can automatically spring back. The present invention comprises a pivot bolt and a die spring, which creates a tension against the carriage bolts. In use, the die spring is tightened, so that it allows the signpost support to fall into a collapsed position. Thus, the die spring prevents the device from springing back automatically.

Finally, U.S. Pat. No. 5,703,577 to Carter comprises a self-erecting traffic control device comprising a base member and a semi-circular bracket assembly that is attached to the base member for receiving a movable sign support member. The sign support member is adapted to hold a signpost on which a sign is mounted. The bracket assembly can pivot so that the signpost and the sign can collapse forward and backward. Carter, however, does not disclose a ground post support that can be secured to an existing ground post. Instead, Carter discloses a semi-circular bracket that must be secured to the ground. Thus, the present invention provides a more convenient means of installing a signpost.

The devices disclosed in the prior art have several known drawbacks. These devices are limited in that they are not designed to be used with existing ground posts and that they do not utilize a die spring. The present invention overcomes these limitations by disclosing a pivotable signpost support device comprising a ground post support that can attach to an existing ground support that is secured to the ground. Additionally, the present invention comprises a signpost support that can pivot about a pair of vertical supports so that the signpost can be positioned in an upright position and a collapsed position. It is therefore submitted that the present invention is substantially divergent in design elements from the prior art, and consequently it is clear that there is a need in the art for an improvement to street sign supports. In this regard, the instant invention substantially fulfills these needs.

SUMMARY OF THE INVENTION

In view of the foregoing disadvantages inherent in the known types of self-righting street signs now present in the prior art, the present invention provides a new and improved pivotable signpost support device wherein the same can be utilized for minimizing damage to street signs and posts when struck by a vehicle or other object.

It is therefore an object of the invention to provide a new and improved pivotable signpost support device that has all of the advantages of the prior art and none of the disadvantages.

Another object of the present invention is to provide a new and improved pivotable signpost support device having a first vertical support and a second vertical support with a signpost support and a ground post support therebetween, wherein the signpost support and the ground post support are vertically aligned.

Yet another object of the present invention is to provide a new and improved pivotable signpost support device that utilizes a pivot bolt and a die spring to pivot a signpost support into an upright position and a collapsed position.

Still yet another object of the present invention is to provide a new and improved pivotable signpost support device that can be moved from an upright position to a collapsed position without causing damage to the sign that is mounted on the device and a passing vehicle.

Still yet another object of the present invention is to provide a new and improved pivotable signpost support device that can be moved from a collapsed position to an upright position with ease.

Still yet another object of the present invention is to provide a new and improved pivotable signpost support device wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
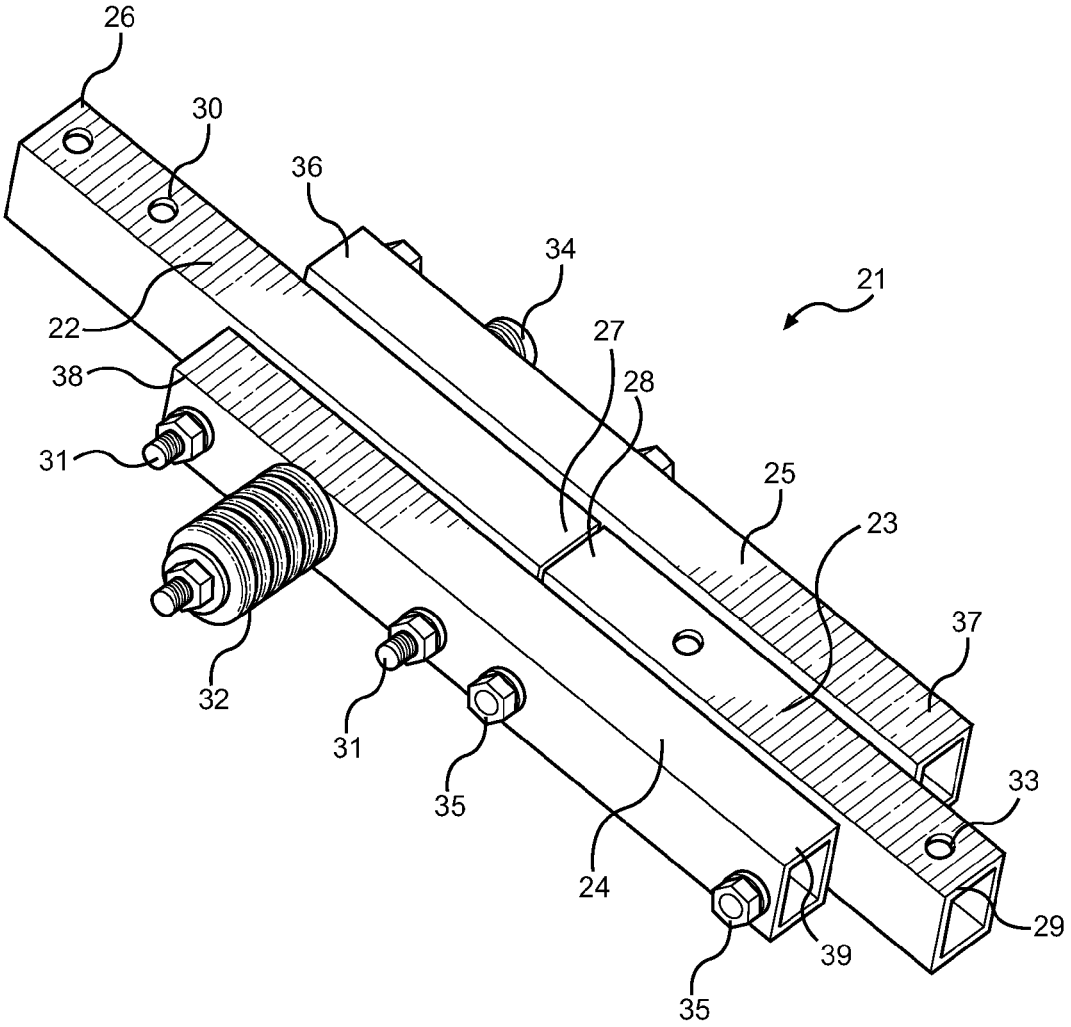
FIG. 1 shows a perspective view of the present invention.

References are made herein to the attached drawings. Like reference numerals are used throughout the drawings to depict like or similar elements of the pivotable signpost support device. For the purposes of presenting a brief and clear description of the present invention, the preferred embodiment will be discussed as used to decrease damages to street signs and posts. The figures are intended for representative purposes only and should not be considered to be limiting in any respect.

Referring now to FIG. 1, there is shown a perspective view of the present invention. The present signpost support device 21 comprises a signpost support 22 and a ground post support 23. Each of the signpost support 22 and the ground post support 23 comprises a rectangular cross section with a hollow interior, thereby defining four sides. The two supports 22, 23 are vertically aligned so that the lower end 27 of the signpost support 22 is adjacent to the upper end 28 of the ground post support 23.

The cross sectional area of the signpost support 22 is substantially equal to the cross sectional area of the ground post support 23. The distance between the upper end 26 and the lower end 27 of the signpost support 22 defines the length of the signpost support 22. Similarly, the distance between the upper end 28 and the lower end 29 of the ground post support 23 defines the length of the ground post support 23. In the illustrated embodiment, the length of the signpost support 22 is greater than the length of the ground post support 23. However, the length of the signpost support 22 may be substantially equal to, or less than the length of the ground post support 23, depending on embodiment and the size and weight of the signpost attached to the signpost support 22. Generally, it is contemplated that the length of the signpost support 22 is greater than the length of the ground post support 23 when the signpost support 22 is supporting a large and a heavy signpost.

The signpost support 22 comprises a pair of apertures 30 on opposing sides, wherein the apertures directly align with one another. Each of the apertures 30 is adapted to receive a fastener therethrough, so that a signpost can be mounted to the signpost support 22. Similarly, the ground post support 23 comprises a pair of apertures 33 on opposing sides. The apertures directly align with one another so as to receive a fastener therethrough. In this way, the ground post support 23 can be attached to the upper end ground post, wherein the ground post is preferably an existing ground post that is secured to the ground. It is contemplated that various types of fasteners, such as bolts, may be used.

The present signpost support device 21 further comprises a first vertical support 24 and a second vertical support 25, wherein the two vertical supports 24, 25 are disposed parallel to each other and are substantially equal in dimension and shape. Thus, the distance between the first end 38 and second end 39 of the first vertical support 24 is substantially equal to the distance between the first end 36 and the second end 37 of the second vertical support 25. Similar to the signpost support 22 and the ground post support 23, each of the first vertical support 24 and the second vertical support 25 comprises a rectangular cross section with a hollow interior, thereby defining four sides. The two vertical supports 24, 25 are disposed on sides of the signpost support 22 and the ground post support 23.

Each of the first vertical support 24 and the second vertical support 25 comprise a first set of apertures on opposing sides thereof and adjacent to the signpost support 22, wherein the apertures directly align with one another. Each of the first set of apertures is adapted to receive a carriage bolt 31 or another suitable fastener therethrough. The head of the bolt 31 is adjacent to the signpost support 22 so that the end of the bolt 31 extends outward and away from the signpost support 22 and the head of the bolt 31 faces toward the signpost support 22. The head of the bolt 31 is self-locking when placed through the first set of apertures, and is held in place via a nut. The carriage bolt 31 is secured to the vertical supports 24, 25 to strengthen their structure.

It is contemplated that the first vertical support 24, the second vertical support 25, and the signpost support 22 further comprise a second set of apertures on opposing sides thereof, and between the first set of apertures. The second set of apertures are directly aligned with one another. In this way, the second set of apertures are adapted to receive a pivot bolt 34 therethrough. The head of the pivot bolt 34 directly contacts the second vertical support 25, and the end of the pivot bolt 34 extends outward from the first vertical support 24. The end of the pivot bolt 34 comprises a die spring 32 so that the die spring 32 is adjacent to the first vertical support 24. The die spring 32 may be secured in place via a nut. The die spring 32 and the pivot bolt 34 allow the signpost support 22 to pivot with respect to the first and second vertical supports 24, 25.

The first vertical support 24, the second vertical support 25, and the ground post support 23 further comprise a third set of apertures on opposing sides thereof, and below the first and second set of apertures. The third set of apertures are adapted to receive a fastener 35 therethrough so as to secure the ground post support 23 to the first and second vertical supports 24, 25. The fastener 35 may comprise bolts and nuts. In this way, the ground post support 23 is affixed to the first and second vertical supports 24, 25 so that the ground post support 23 remains parallel to the first and second vertical supports 24, 25.

Figure 2:
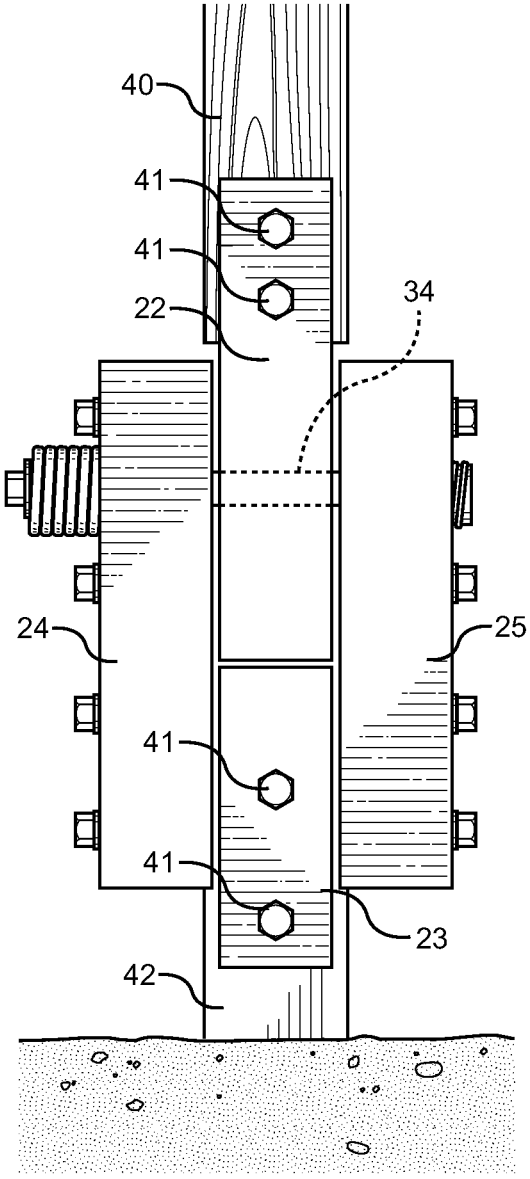
FIG. 2 shows a close-up reverse view of the present invention in use.

Referring now to FIG. 2, there is shown a close-up reverse view of the present invention as mounted to a signpost 40 and a ground post 42. A signpost 40 is secured to the signpost support 22 via one or more fasteners 41, such as bolts or screws. The signpost 40 may comprise a plurality of apertures thereon, wherein the apertures are vertically aligned and separated at regular intervals. In this way, the signpost 40 can be mounted flush to the signpost support 22 at a desired height. Preferably, the signpost 40 is secured near the upper portion of the signpost support 22 so that it does not directly contact the first vertical support 24 and the second vertical support 25. This allows the signpost 40 and the signpost support 22 to pivot forward or backward via the pivot bolt 34 relative to the first and second vertical supports 24, 25.

Similarly, the ground post 42 is secured to the ground post support 23 by means of one or more fasteners 41 such as bolts or screws. The ground post 42 is configured to be mounted flush against the ground post support 23. The ground post 42 may be an existing ground post that is already secured to the ground. It is contemplated that the ground post 42 is inserted approximately two feet into the ground, so that it is prevented from being easily knocked over. The ground post 42 may comprise a plurality of apertures that can be aligned with apertures on the ground post support 23 so as to receive fasteners 41 therethrough. The ground post 42 is mounted to the ground post support 23 so that the ground post 42 does not extend beyond the upper end of the ground post support 23. In this way, the ground post 42 does not interfere with the signpost support 22 when it pivots into a collapsed position.

Figure 3A:
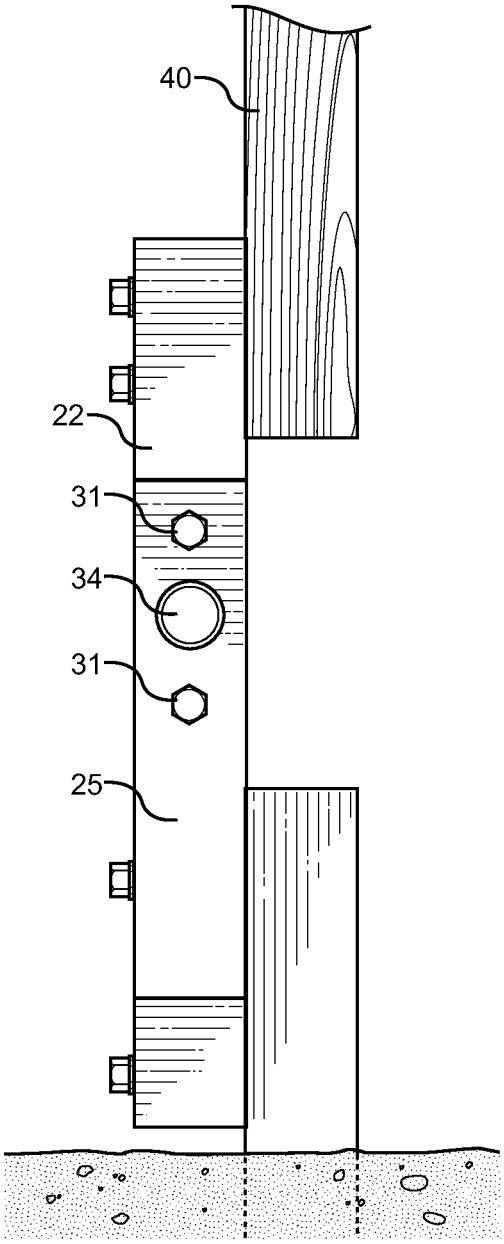
FIG. 3A shows a close-up side view of the present invention in an upright position.
Figure 3B:
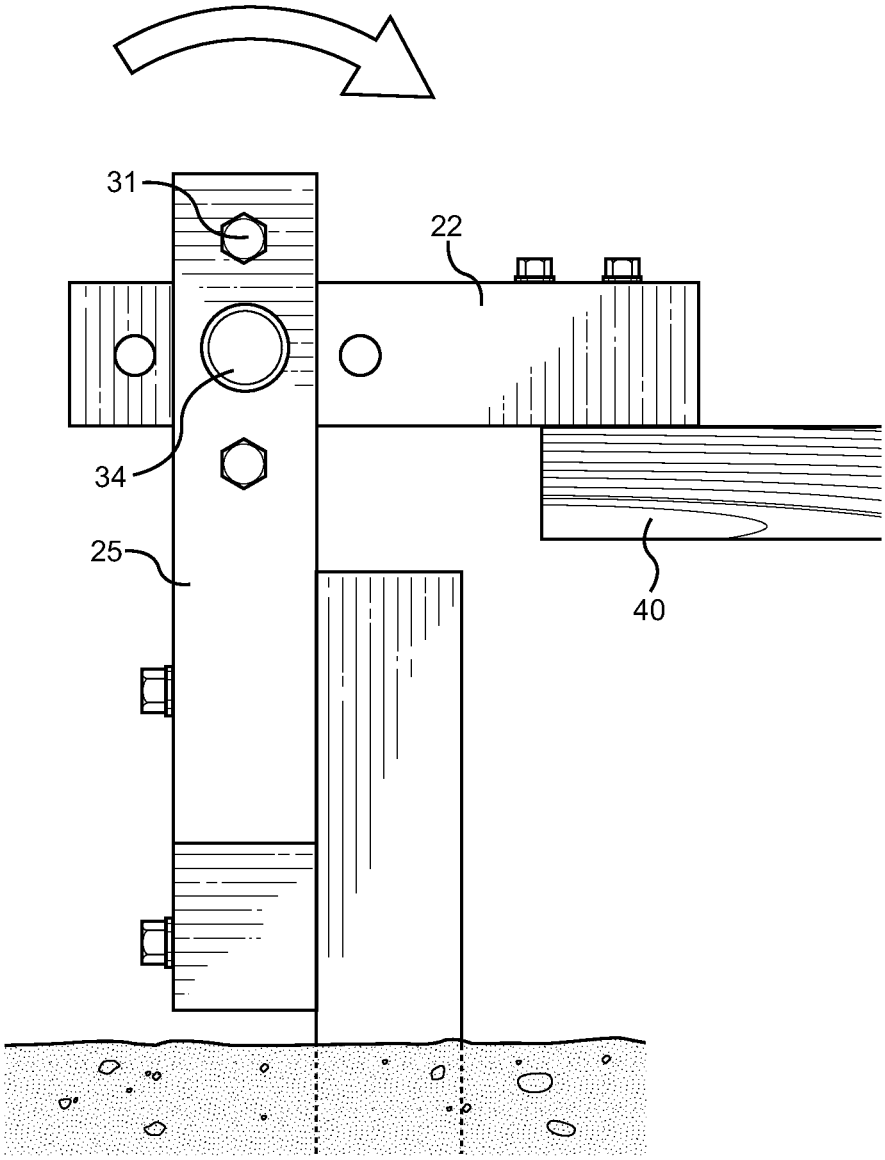
FIG. 3B shows a close-up side view of the present invention in a collapsed position.

Referring now to FIGS. 3A and 3B, there are shown views of the present invention in an upright position and in a collapsed position, respectively. In the illustrated embodiments, the present invention comprises a first pair of carriage bolts 31 above the pivot bolt 34 and a second pair of carriage bolts 31 below the pivot bolt 34, wherein the carriage bolts 31 are inserted through a first set of apertures on the first vertical support and the second vertical support 25. The head of the pivot bolt 34 directly contacts the second vertical support 25 so that the end of the pivot bolt 34 extends outward at the first vertical support 25.

The end of the pivot bolt 34 comprises a die spring, which is secured in place via a nut. The die spring can be tightened around the pivot bolt 34 by turning the nut on the pivot bolt 34 to stabilize the signpost support 22 in an upright position. When hit by wide farming equipment or vehicles, the die spring is compressed, allowing the signpost support 22 to fall into a collapsed position. The signpost support 22 may fall forward or backward, so that it can collapse when hit by farming equipment or vehicles traveling either directions on the road. After the signpost support 22 is collapsed, it can be manually moved into an upright position without causing damage to the signpost 40.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pivotable signpost support device, comprising:

a first vertical support and a second vertical support;

a signpost support;

a ground post support;

wherein said signpost support and said ground post support are vertically aligned;

said signpost support and said ground post support disposed between said first vertical support and said second vertical support such that said signpost support, said first vertical support, and said second vertical support are substantially aligned in a first plane;

said signpost support pivotally attached to said first vertical support and said second vertical support via a pivot bolt;

wherein said signpost support is adapted to move from an upright position into a collapsed position when pivoting about said pivot bolt, whereby said signpost support is adapted to pivot between said first vertical support and said second vertical support about said pivot bolt in a direction out of said first plane;

said ground post support attached to said first vertical support and said second vertical support via one or more fasteners a spring attached to an end of said pivot bolt;

wherein said spring resists said signpost support when said signpost support is pivoted from said upright position such that said signpost support substantially returns to said upright position after being pivoted therefrom.

2. The pivotable signpost support device of claim 1, wherein said spring further comprises a die spring attached to an end of said pivot bolt;

wherein said die spring compresses when said signpost support is moved into said collapsed position.

3. The pivotable signpost support device of claim 1, wherein said ground post support comprises a pair of apertures on opposing sides thereof, wherein said pair of apertures of said ground post support are horizontally aligned;

each of said pair of apertures of said ground post support adapted to receive a fastener therethrough to attach to a ground post.

4. The pivotable signpost support device of claim 1, wherein said signpost support comprises a pair of apertures on opposing sides thereof, wherein said pair of apertures of said signpost support are horizontally aligned;

each of said pair of apertures of said signpost support adapted to receive a fastener therethrough to attach to a signpost.

5. The pivotable signpost support device of claim 1, wherein each of said first vertical support, said second vertical support, said signpost support, and said ground post support each comprise a rectangular cross section.

6. The pivotable signpost support device of claim 1, wherein each of said first vertical support and said second vertical support further comprises at least one carriage bolt extending therebetween.

7. The pivotable signpost support device of claim 1, wherein a lower end of said signpost support is adjacent to an upper end of said ground post support.

8. The pivotable signpost support device of claim 1, wherein a head of said pivot bolt bears against said second vertical support and an opposite end of said pivot bolt extends outward from said first vertical support;

said opposite end of said pivot bolt having said spring thereon.

* * * * *